US012673246B2

(12) United States Patent
Holland

(10) Patent No.: US 12,673,246 B2
(45) Date of Patent: Jul. 7, 2026

(54) EQUESTRIAN RIDER TRAINING HARNESS

(71) Applicant: SAINTS & ANGELS, LLC, Scottsdale, AZ (US)

(72) Inventor: Shelle Annette Holland, Scottsdale, AZ (US)

( * ) Notice: Subject to any disclaimer, the term of this patent is extended or adjusted under 35 U.S.C. 154(b) by 272 days.

(21) Appl. No.: 18/672,946

(22) Filed: May 23, 2024

(65) Prior Publication Data

US 2024/0390759 A1 Nov. 28, 2024

Related U.S. Application Data

(60) Provisional application No. 63/504,536, filed on May 26, 2023.

(51) Int. Cl.
*A63B 69/00* (2006.01)

(52) U.S. Cl.
CPC ..... *A63B 69/0059* (2013.01); *A63B 2244/24* (2013.01)

(58) Field of Classification Search
CPC .. G09B 19/003; G09B 19/0038; B68C 1/147; B68C 2001/022
See application file for complete search history.

(56) References Cited

U.S. PATENT DOCUMENTS 3,916,604 A * 11/1975 Phipps ..... B68C 1/027 54/44.2
4,164,834 A * 8/1979 Christensen ..... B68C 1/16 54/46.1
4,942,721 A * 7/1990 Van Scoyk ..... B68C 1/16 54/46.1
5,685,133 A 11/1997 Travis
6,095,819 A * 8/2000 Ferrand ..... G09B 19/0038 434/247
6,769,235 B1 8/2004 Hayes
7,093,413 B1 * 8/2006 Hughes ..... B68C 1/147 54/44.1

(Continued)

OTHER PUBLICATIONS

Form PCT/ISA/210 International Search Report of the International Searching Authority from International Patent Application No. PCT/US2024/031183, dated Sep. 11, 2024.

(Continued)

*Primary Examiner* — Peter R Egloff
(74) *Attorney, Agent, or Firm* — Parsons & Goltry, PLLC; Michael W. Goltry; Robert A. Parsons

(57) ABSTRACT

A harness includes a loop including an assembly of interconnected straps and buckles. The straps include first, second, and third straps. The buckles include first, second, and third buckles, each openable for opening the loop. The first strap extends between the first and second buckles and has a back support between the first and second buckles. The second strap extends between the first and third buckles. The third strap extends between the second and third buckles. The first buckle, the third buckle, the first strap extending from the back support to the first buckle, and the second strap define the loop's first section. The second buckle and the first strap extending from the back support to the second buckle define the loop's second section opposing the loop's first section. The third strap extending between the second buckle and the third buckle define the loop's third section.

3 Claims, 9 Drawing Sheets

(56) References Cited

U.S. PATENT DOCUMENTS

| | | | | |
|---|---|---|---|---|
| 2003/0059753 | A1* | 3/2003 | Mack ..... | A63B 69/00<br>434/247 |
| 2003/0121237 | A1 | 7/2003 | Earnhart | |

OTHER PUBLICATIONS

Form PCT/ISA/237 Written Opinion of the International Searching Authority from International Patent Application No. PCT/US2024/031183, dated Sep. 11, 2024.

* cited by examiner

EQUESTRIAN RIDER TRAINING HARNESS

FIELD OF THE INVENTION

The present invention relates to harnesses and, more particularly, to a training harness configured to promote or otherwise reinforce recommended saddle-sitting techniques in the field of equitation.

DESCRIPTION OF RELATED ART

An equestrian saddle is a supportive structure for a rider of a horse, fastened to the horse's back by the saddle's girth strap attached at both ends to the saddle. Many styles of modern saddles exist, western and dressage-type English saddles the most common, each designed for a specific equestrianism discipline. A saddle should fit the horse and the rider. The rider should sit correctly in the saddle, balanced, relaxed, upright, and centered according to recommended techniques to ensure the horse and the rider work in unison, enable the rider to communicate with the horse, and promote the comfort and safety of the horse and its rider.

Most riders fail to sit on a saddle according to recommended techniques, by sitting on the saddle with open hips, steady legs under the body, a relaxed and supple back, an open upper body, and shoulders, back, elbows, hands, and head in their correct and relaxed positions, or have trouble doing so, even with direct verbal instruction and guidance from skilled instructors. Accordingly, skilled artisans have developed training devices configured to couple between the horse and its rider to physically encourage the rider to sit on the saddle according to the recommended techniques.

One known training device useful with different saddle types consists of a harness, including a strap configured with an attached, padded back support. The strap has left and right lengths or sections that extend outward from the back support's respective left and right sides. The outer end of the left section threads through two D-rings and doubles back over and secures the left section's standing part, forming a loop that secures the D-rings. A user places the strap around the back of a rider seated on a saddle worn by a horse, situating the back support against the rider's lower back and extending the left and right sections downward across the rider's respective left and right thighs on either side of the horse. She wraps the left and right sections over the saddle's girth strap or cinch extending under the horse's underside just behind the horse's front legs and threads the outer end of the right section through the D-rings, connecting the right section to the left section. She pulls the right section's outer end through the D-rings, tightening the strap over the saddle's girth strap, the rider's left and right thighs, and the back support over the rider's lower back. The strap is length adjustable through the D-rings, allowing the user to adjust its length to ensure the training device fits properly and snuggly around the horse and its rider. The training device now installed between the horse and its rider physically reinforces the rider to sit on the saddle according to the recommended techniques by a forward tension exerted by the back support against the rider's lower back, urging the rider to sit upright, and a downward tension exerted by the left section against the rider's left thigh and a downward tension exerted by the right section against the rider's right thigh, urging the rider downward into the saddle.

However, the D-rings used to connect the strap's left section to its right section is not satisfactory because it is cumbersome, inherently difficult and time-consuming to secure and release, and requires specialized knowledge to use correctly. When the strap is tightened and under tension, the D-rings clamp down on the strap, making it difficult a time-consuming to release the D-rings, particularly by the rider using one hand while seated in the saddle. In addition, the strap can slide fore or aft off the saddle's girth strap directly against the horse's underside, loosening the strap, causing the horse to experience discomfort, and disrupting the proper installation of the training device. When the strap is released by releasing the D-ring configuration, releasing the strap's left section from its right section, the strap inherently falls away from the girth strap, allowing it to become entangled in the horse's legs or startle the horse. Accordingly, it is evident that there is an ongoing need for continued improvement in the art.

SUMMARY OF THE INVENTION

Disclosed is a harness for use with a rider seated astride on a saddle secured atop a back of horse by a girth strap extending around a barrel of the horse from either side of the saddle, the harness for reinforcing recommended saddle-sitting techniques. The harness includes a loop, an assembly of interconnected straps and buckles. The straps include a first strap, a second strap, and a third strap. The buckles include a first buckle, a second buckle, and a third buckle. The first buckle, the second buckle, and the third buckle are each independently openable for opening the loop, and independently closable for closing the loop. The first strap extends between the first buckle and the second buckle. The second strap extends between the first buckle and the third buckle. The third strap extends between the second buckle and the third buckle. The first straps includes a back support between the first buckle and the second buckle. The first buckle, the third buckle, the first strap extending from the back support to the first buckle, and the second strap extending from the first buckle to the third buckle form a first section of the loop. The second buckle and the first strap extending from the back support to the second buckle form a second section of the loop opposing the first section of the loop. The third strap extending between the second buckle and the third buckle is a third section of the loop. The loop is configured be wrapped under tension around the horse from the back support applied against the rider's lower back so the first section and the second section extend outward, downwardly, and forwardly from the back support over either side of the rider and downward along either side of the horse, the third section extends over the girth from the second buckle to the third buckle below the first buckle, forward tension exerted by the back support against the rider's lower back urges the rider to sit upright, and downward tension exerted by the first section and second section against either side of the rider urges the rider downward into the saddle. The second buckle includes a first buckle part and a second buckle part. The second buckle part includes a latch and a wrist strap extending from the latch. The first buckle part is received by the second buckle. The latch is in a closed position, securing the first buckle part to the second buckle part. The latch is movable out of the closed position to an open position, releasing the second buckle part from the first buckle part in response to pulling against the outer end by the wrist strap, opening the loop. A retention band encircles the girth and the third section of the loop under the barrel of the horse.

BRIEF DESCRIPTION OF THE DRAWINGS

Specific objects and advantages of the invention will become apparent to those skilled in the art from the following detailed description of illustrative embodiments thereof, taken in conjunction with the drawings in which.

DETAILED DESCRIPTION

Disclosed is a training harness configured to physically promote, encourage or otherwise reinforce recommended saddle-sitting techniques, namely, to promote, encourage or otherwise reinforce a rider to sit astride on a horse-worn saddle with open hips, steady legs under the body, a relaxed and supple back, an open upper body, and shoulders, back, elbows, hands and head in their correct and relaxed positions. The training harness is inexpensive, easy to construct, easy to use, efficient, effective, easy to open and close, comfortable for the horse and the rider, and useful with different saddle types, such as western saddles and dressage-style English saddles.

Figure 1:
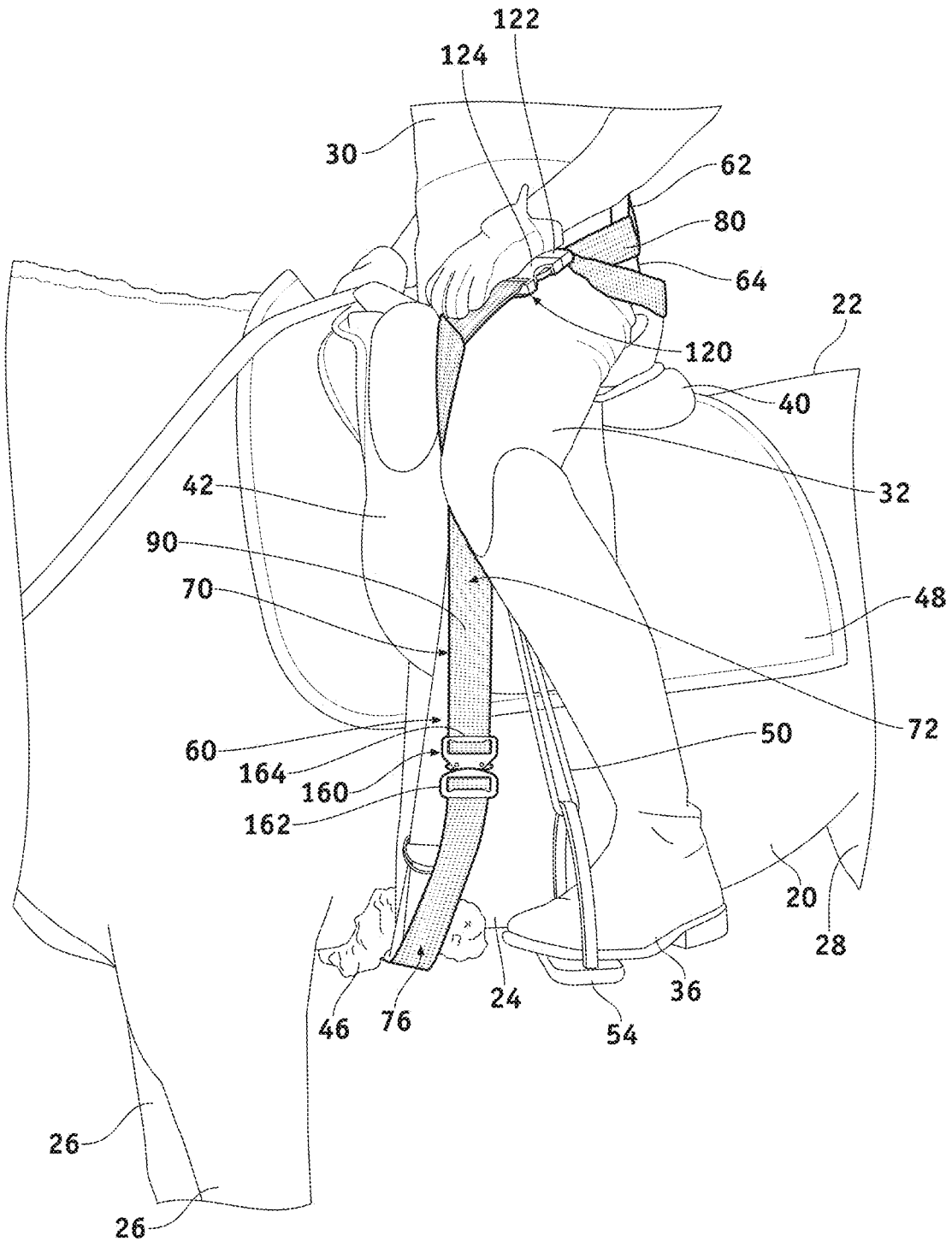
FIGS. 1-3 are perspective views of a harness for use with a rider seated astride on a saddle secured atop a back of horse by a girth strap extending around a barrel of the horse from either side of the saddle for reinforcing recommended saddle-sitting techniques, the harness constructed and arranged according to the invention and including a back support and a loop extending outward from either side of the back support, the loop including straps interconnected by buckles.
Figure 2:
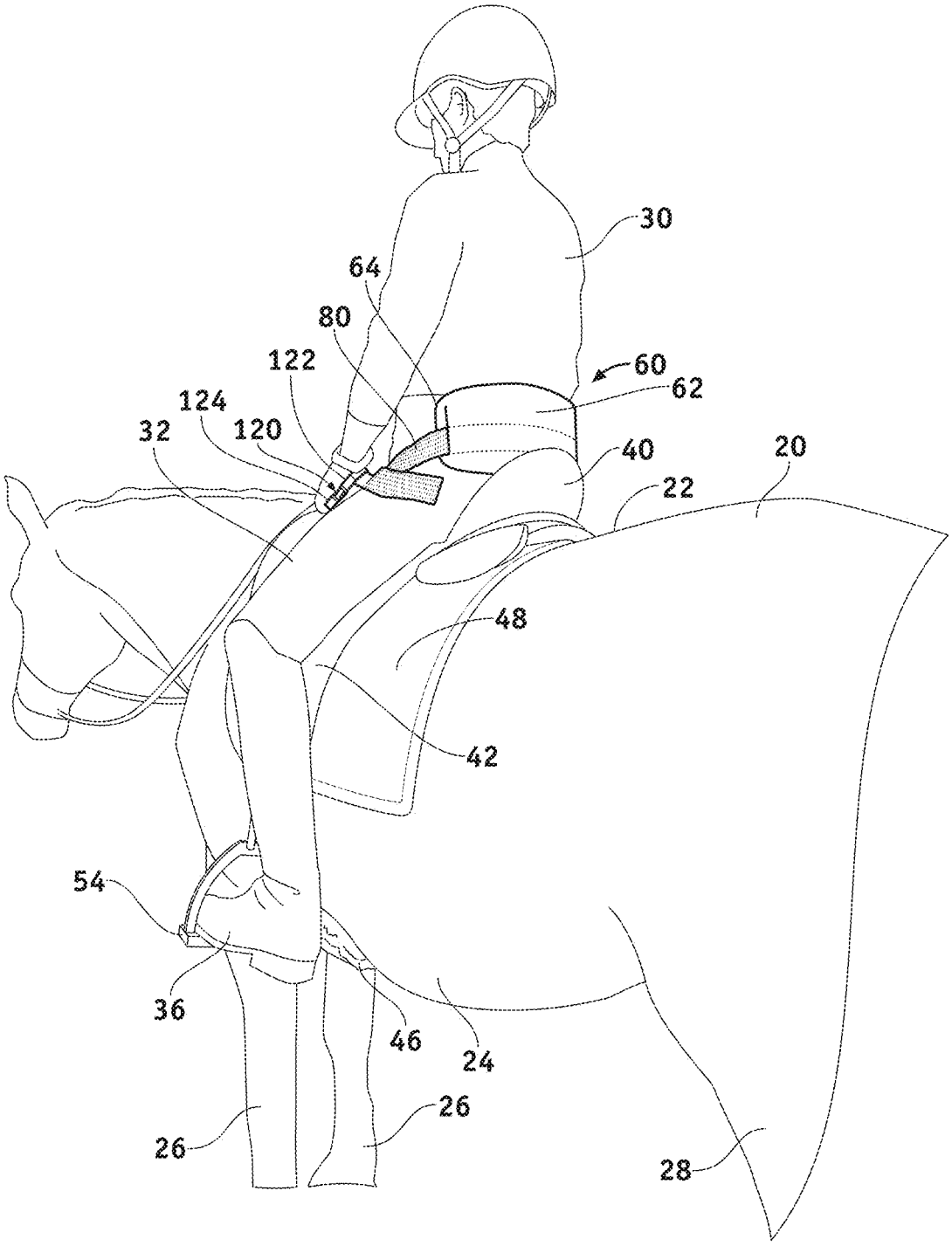
Figure 3:
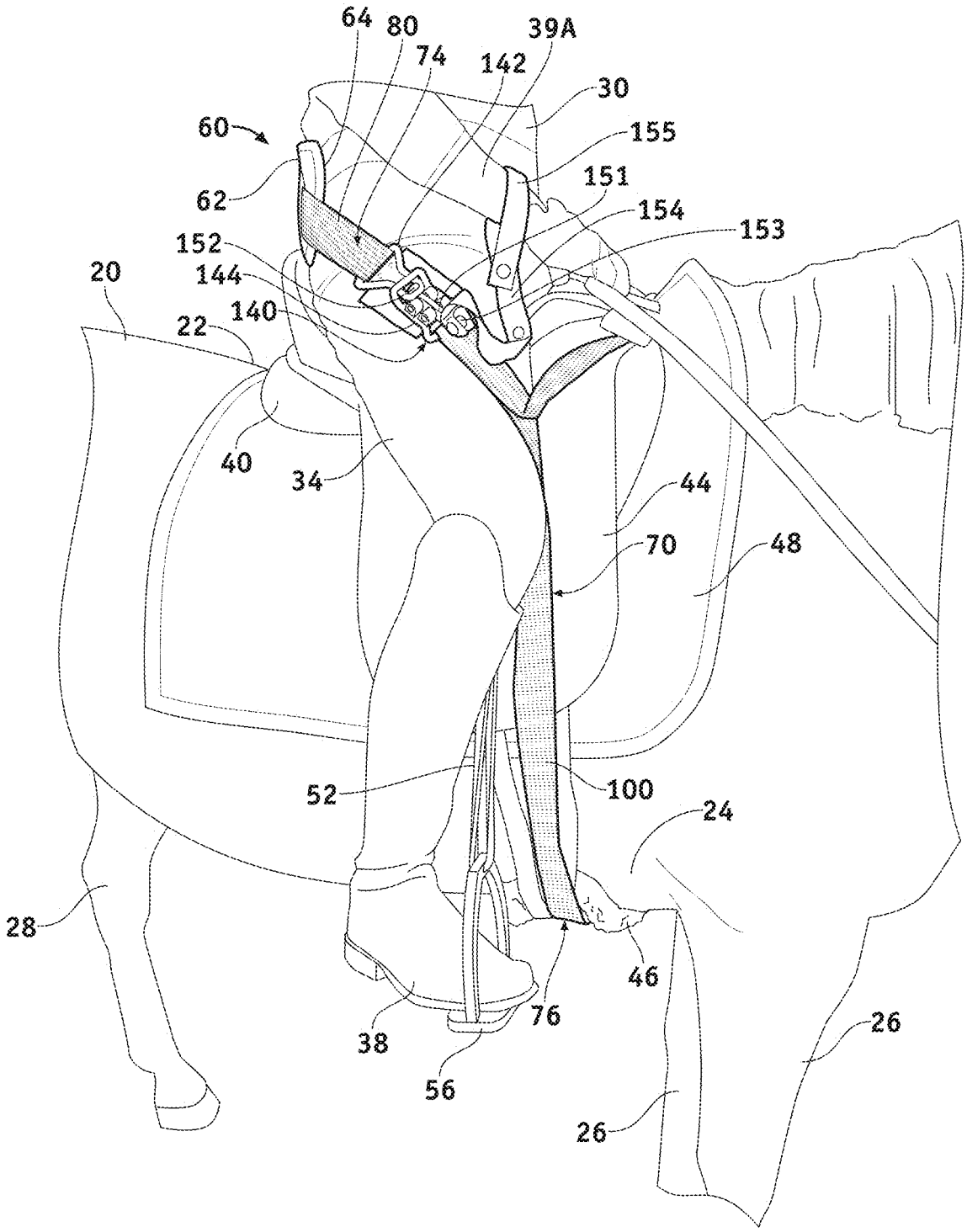

Referring to FIGS. 1-3, relevantly, shown is horse 20 including a back 22 and a barrel 24 between its front legs 26 and its rear legs 28, and a rider 30 seated astride on a saddle 40. The saddle 40 has opposed sides 42 and 44. The side 42 is the saddle's 40 left side. The side 44 is the saddle's 40 right side. The saddle 40 is secured atop the horse's 20 back 22 by a girth strap 46 extending around the horse's 20 barrel 24 behind the horse's 20 front legs 26 from the saddle's 40 side 42 on the horse's 20 left side to the saddle's 40 side 44 on the horse's right side, securing the saddle 40 to the horse 20. The saddle 40 is fit over a saddle pad 48 draped over the horse's 20 back 22. Straps 50 and 52 depending downward from the respective sides 42 and 44 of the saddle support respective stirrups 54 and 56 on horse's 20 left and right sides, respectively. The rider 30, an adult human, is seated upright and forwardly in the horse-worn saddle 40 under the influence of a harness 60 coupled between her and the horse 20. The rider's 30 legs 32 and 34 extend downward along either side of the saddle 40 and the horse 20 to her feet, one foot 36 in the stirrup 54 one side of the horse 20 and the other foot 38 in the other stirrup 56 on the other side of the horse 20. The harness 60 is a training harness configured be wrapped under tension around the horse 20 and it's rider 30 to physically promote, encourage, or otherwise reinforce recommended saddle-sitting techniques by the rider 30, namely, to sit on the saddle 40 as shown with open hips, steady legs under the body, a relaxed and supple back, an open upper body, and shoulders, back, elbows, hands and head in their correct and relaxed positions. In this example, the saddle 40 is a standard dressage-type English saddle, having all the standard accompanying rigging or appurtenances.

Referring to FIGS. 1-5, relevantly, the harness 60 is a loop 70, including a back support 62. The back support 62 is broad, flat, reinforced structurally, such as with one or more enclosed stiffeners of plastic, carbon fiber, or the like, and padded for rider 30 comfort. It has opposed sides 64 and 66. The loop 70 extends outward from the respective sides 64 and 66 of the back support 62. The loop 70 includes straps 80, 90, and 100 interconnected by a plurality of assembled or closed buckles, including a buckle 120, a buckle 140, and a buckle 160. Each of the straps 80, 90, and 100 is a strong, rugged elongate safety strap or web of nylon, canvas or other similar material or combination of materials having inherently strong, rugged, inelastic, and tear-resistant material characteristics. The buckles 120, 140, and 160 are each independently openable and closable. The loop 70 is closed when the buckles 120, 140, and 16 are each assembled or closed. The loop 70 is opened by disassembling or opening the buckle 120, disassembling or opening the buckle 140, or disassembling or opening the buckle 160. The buckles 120, 140, and 160, quick-release buckles, are different from one another and can be repeatedly, quickly, and independently opened and closed.

The buckle 120 includes two buckle parts 122 and 124 configured to be repeatedly opened, i.e. disassembled, and closed, i.e. assembled. The buckle 140 includes two buckle parts 142 and 144 configured to be repeatedly opened, i.e. disassembled, and closed, i.e. assembled. The buckle 160 includes two buckle parts 162 and 164 configured to be repeatedly opened, i.e. disassembled, and closed, i.e. disassembled. The strap 80 is coupled between the buckle 120 and the buckle 140 on either side of the back support 62. The back support 62 is coupled to the strap 80 between the buckles 120 and 140. The strap 90 is coupled between the buckle 120 and the buckle 160. The strap 100 is coupled between the buckle 140 and the buckle 160. More specifically, the strap 80 is coupled between the buckle part 122 in FIGS. 1, 4 and 5, and the buckle part 142 in FIGS. 3, 4 and 5. The strap 90 is coupled between the buckle part 124 and the buckle part 164, in FIGS. 1, 4 and 5. The strap 100 coupled between the buckle part 162 in FIGS. 1, 4 and 5 and the buckle part 144 in FIGS. 1, 3, 4, and 5.

Figure 4:
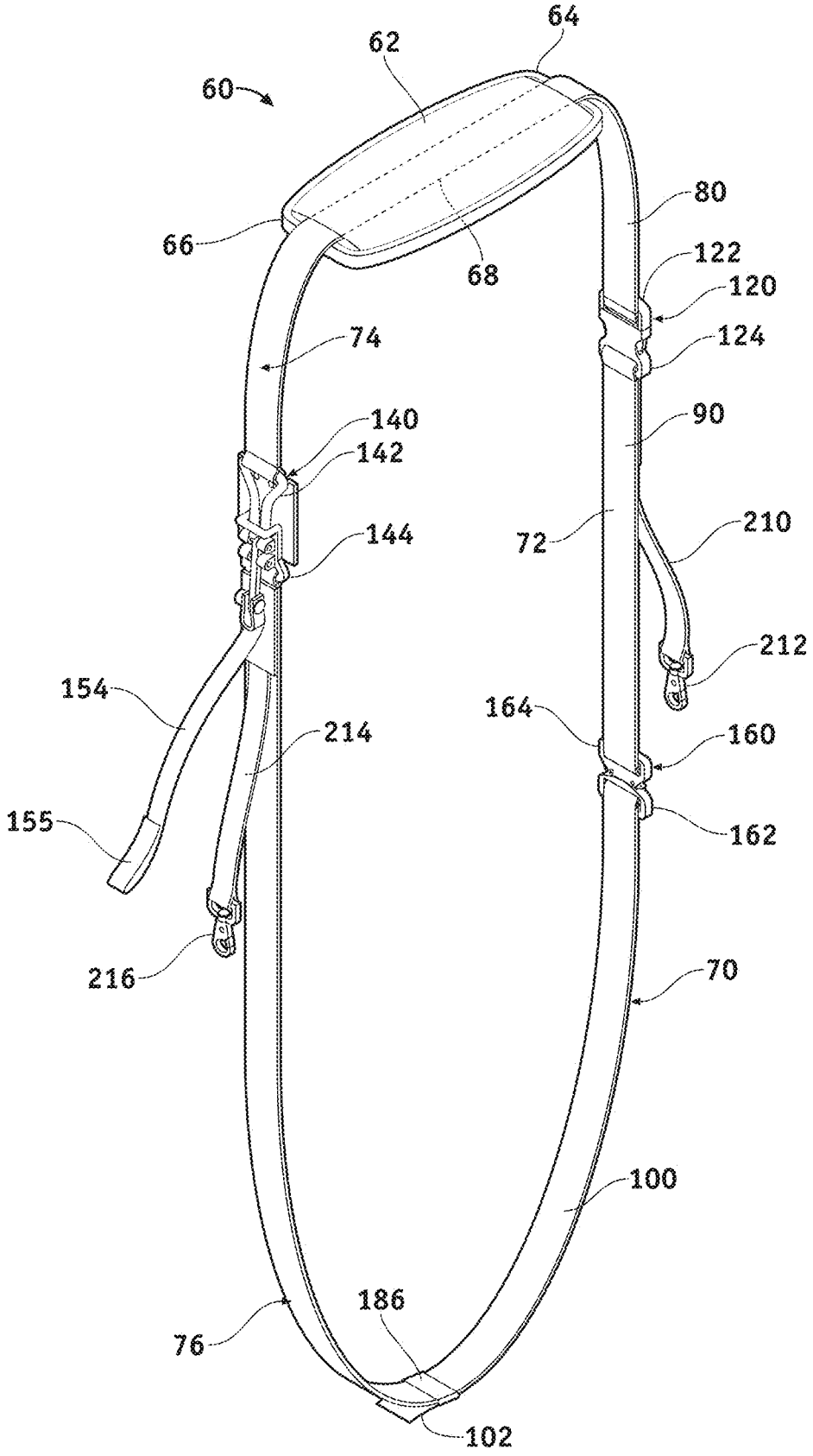
FIGS. 4 and 5 are perspective views of training harness first illustrated in FIGS. 1-3.
Figure 5:
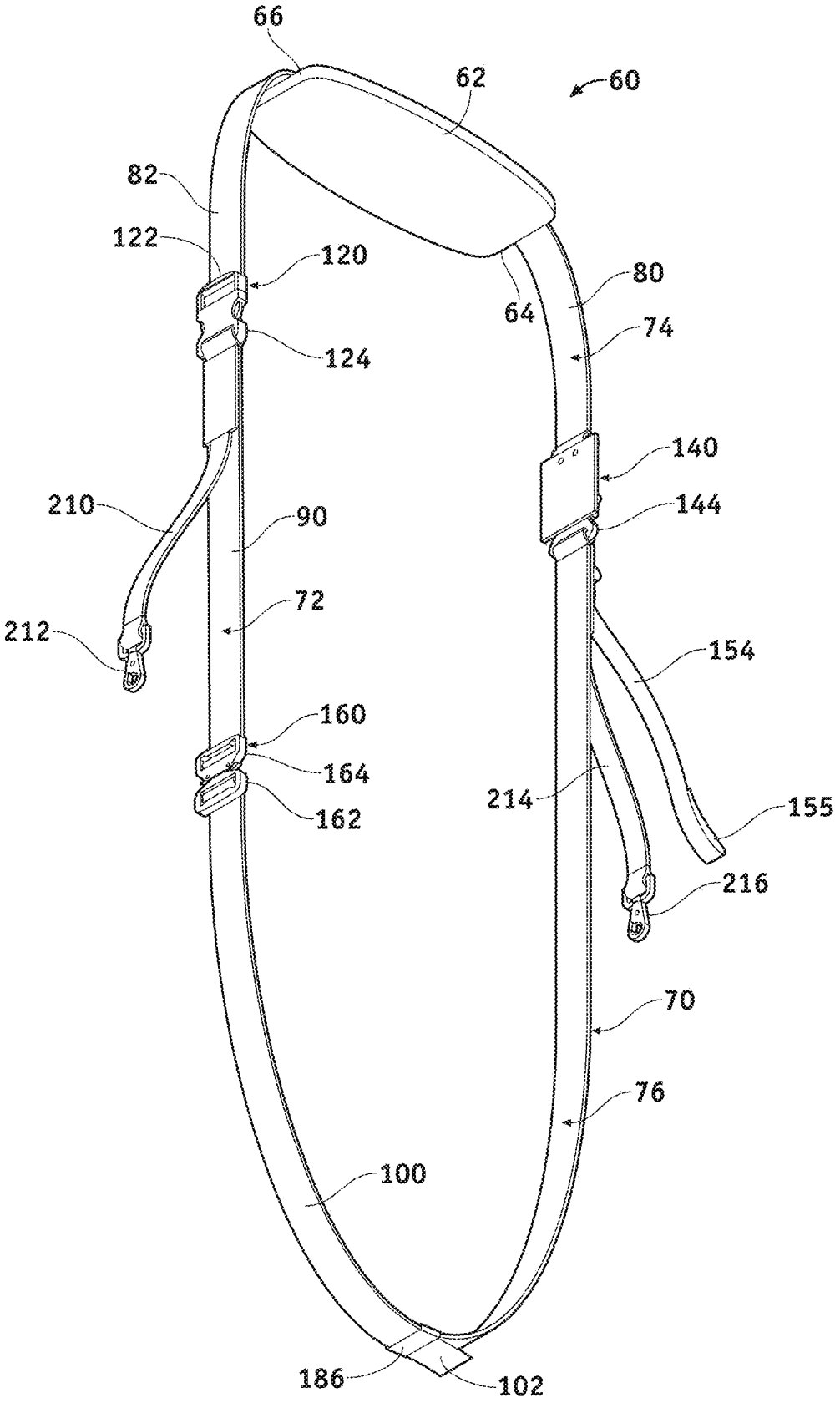

Referring to FIGS. 4 and 5, relevantly, the back support 62 has a pocket 68. The pocket 68 extends through the back support 62 from side 64 to side 66. The pocket 68 is open at each of the sides 64 and 66. The strap 80 extends through the pocket 68 from side 64 to side 66, coupling the back support 62 to the strap 80. The strap 80 extends outward from the pocket 68 beyond the side 64 to the buckle 120 and outward from the pocket 68 beyond the side 66 to the buckle 140. The strap 80 is free to slide through the pocket 68, allowing a user to adjust the position of the back support 62 along the strap 80 by sliding the back support 62 over the strap 80 or sliding the strap 80 through the pocket 68. Alternately, the strap 80 can be fixed in place to the back support 62, such as by stitching or adhering the strap 80 to the back support 62, at an intermediate position between the buckles 120 and 140. The loop 70 defines sections 72, 74, and 76. According to the invention, the buckles 120 and 160, the strap 80 extending outward from the side 64 of the back support 62 to the buckle 120, and the strap 90 extending from the buckle 120 to the buckle 160 define the section 72. According to the invention, the buckle 140 and the strap 80 extending outward from the side 64 of the back support 62 to the buckle 140 define the second section 74. According to the invention, the strap 100 extending between the buckle 140 and the buckle 160 define the third section 76 between the sections 72 and 74. The positions of the buckles 120, 140, and 160 on the harness 60 and how they correspond to the sections 72, 74, and 76 dictate how the harness 60 operates as described throughout this specification.

Figure 6:
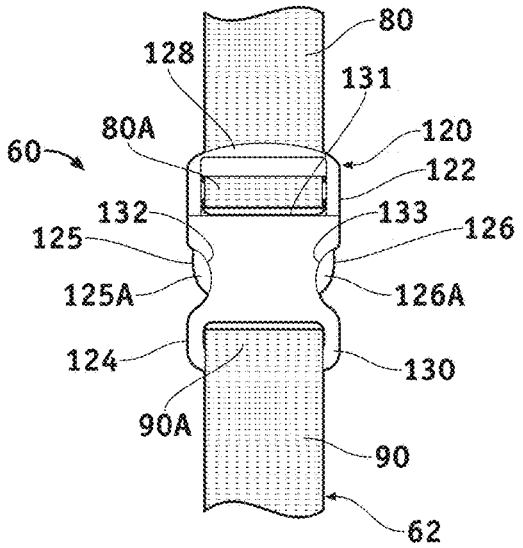
FIG. 6 is a fragmentary view of the training harness of FIGS. 4 and 5, illustrating two buckle parts of one of the buckles as assembled or closed, closing the loop therebetween.
Figure 7:
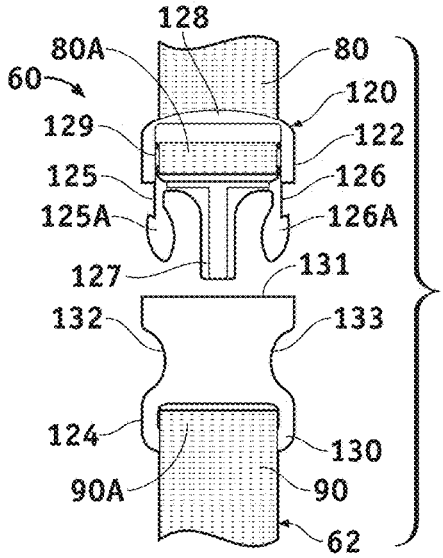
FIG. 7 is a view corresponding to FIG. 6, illustrating the two buckle parts as disassembled or opened, opening the loop therebetween.

The buckle 120 is a standard, inexpensive, and readily available buckle. In this embodiment, it is a conventional side squeeze buckle of plastic. Its buckle part 122 is a first or male buckle part and its buckle part 124 is a second or female buckle part. Referring to FIGS. 6 and 7, relevantly, the buckle part 122 is a body having two spring arms 125 and 126 and an eyelet 128, a ring or annular part of the buckle part 124. The spring arms 125 and 126 are equally spaced from a center rod 127 all extending from the eyelet 128, a ring or annular part of the buckle part 122 configured with a transversely extending bar 129. The bar 129 is a fixed bar or a displaceable clamping bar. The spring arms 125 and 126 have retaining blocks 125A and 126A that terminate at the free ends of the respective spring arms 125 and 126. The buckle part 124 is a body having an eyelet 130, a ring or annular part of the buckle part 124, opposing an open end 131 that is open to opposed side holes 132 and 133 between the eyelet 130 and the open end 131. The side holes 132 and 133 receive the spring arms 125 and 126 that secure the buckle part 124 when the spring arms 125 and 126 are inserted into the buckle part 124 through the open end 131, securing the buckle part 122 to the buckle part 124, securing the strap 80 to the strap 90. Squeezing the spring arms 125 and 126 inwardly by hand at the opposed side holes 132 and 133 releases the retaining blocks 125A and 126A from the buckle part 124, releasing the buckle part 122 from the buckle part 124, allowing the buckle part 122 and the buckle part 124 to be separated in FIG. 7 by pulling them apart, separating the strap 80 from the strap 90. The buckle parts 122 and 124 can be repeatedly assembled, i.e. closed, and disassembled, i.e. opened, by hand, as described. Since the buckle 120 is a standard side squeeze buckle, further details of the buckle parts 122 and 124 will readily occur to the person having ordinary skill in the art.

In FIGS. 4 and 5, the strap 80 extends outward from the pocket 68 from side 64 to the buckle part 122. In FIGS. 6 and 7, the strap's 80 free end 82 threads through the eyelet 128, around the bar 129, and doubles back over but is not secured to the strap's 80 standing part, forming an open loop 80A in the strap 80 that secures the buckle part 122. Guiding the strap 80 back and forth through the eyelet 128 over the bar 129 allows a user to adjust the strap's 80 length between the buckles 120 and 140, between the buckle's 120 buckle part 122 and the buckle's 140 buckle part 142.

Figure 8:
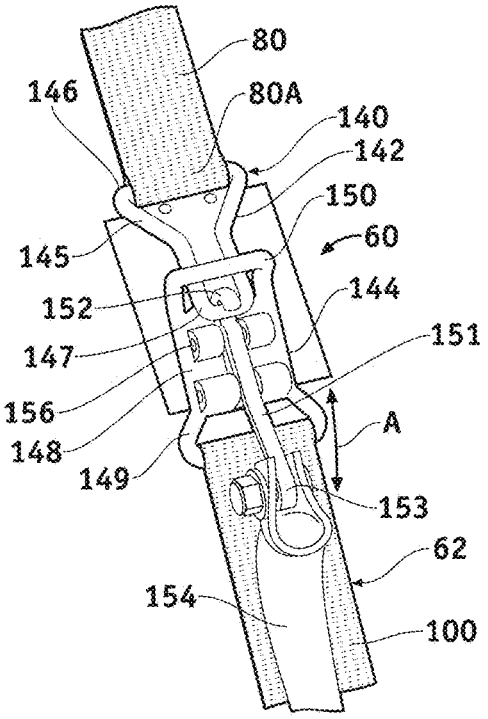
FIG. 8 is a fragmentary view of the training harness of FIGS. 4 and 5, illustrating two buckle parts of another one of the buckles as assembled or closed, closing the loop therebetween.
Figure 9:
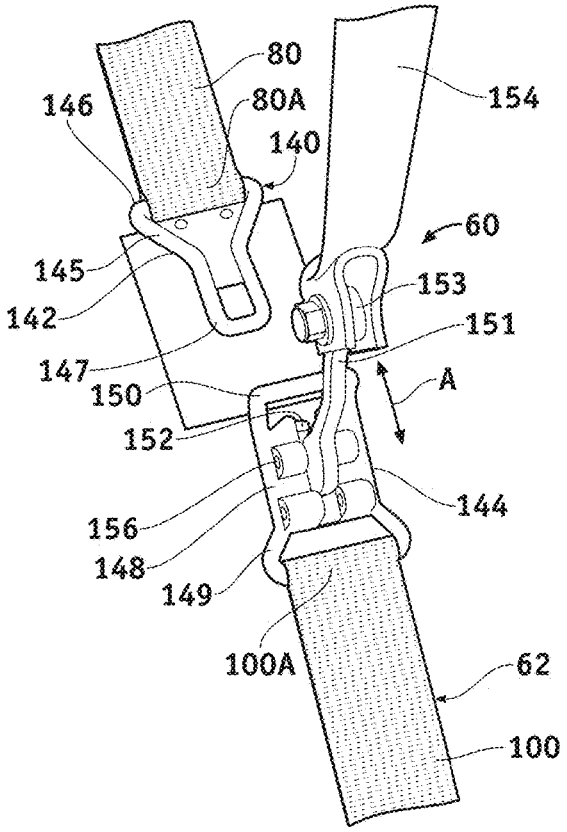
FIG. 9 is a view corresponding to FIG. 8, illustrating the two buckle parts as disassembled or opened, opening the loop therebetween.

The buckle 140 is a safety buckle. It is a known auto-release buckle. The buckle part 142 is a male buckle part and the buckle part 144 is a female buckle part, both of metal. Referring to FIGS. 8 and 9, relevantly, the buckle part 142 is a tongue 145, a frame including a connecting end 146 and an insert end 147. The buckle part 144 includes a frame 148. The frame 148 has an eyelet 149 and an open end 150. The eyelet 149, a ring or annular part of the buckle part 144, and the open end 150 are at opposite ends of the frame 148. The frame 148 has a latch 151 configured to secure and release the buckle part 142. The latch 151 is between the eyelet 149 and the open end 150. The latch 151 has opposed ends 152 and 153. The end 152, an inner or engagement end, is hooked. The end 153 is an outer or free end. It is connected to a strap 154 configured with a loop 155 adapted to receive and loop around a rider's wrist. The strap 154, a wrist strap, extends outward from the outer end 153 of the latch 151 to the loop 155 in FIGS. 4 and 5. A pivot 156 pivotally connects the latch 151 proximate to its inner end 152 to the frame 148 between the eyelet 149 and the open end 150. The latch 151 turns about the pivot 120, in the directions of double arrow A, between a closed position of in FIG. 8 and an open position in FIG. 9. The inner end 152 is in its closed position when the latch 151 is in its closed position, in FIG. 8. The inner end 152 is in its open position when the latch 151 is in its closed position, in FIG. 9. Inserting the insert end 147 into the frame's 148 open end 150 and turning the latch 151 about the pivot 156 from its open position in FIG. 9 to its closed position in FIG. 8 hooks the latch's 151 inner end 152 over the tongue's 145 insert end 147, securing the latch 151 to the tongue 145, securing the buckle part 142 to the buckle part 144, securing the strap 80 to the strap 100. Turning the latch 151 about the pivot 156 out of its closed position in FIG. 8 to its open position in FIG. 9 withdraws the inner end 152 from over the tongue's 145 insert end 147, releasing the latch 151 from the tongue's insert end 147, releasing the buckle part 142 from the buckle part 144, allowing them to be separated in FIG. 9 by pulling them apart, separating the strap 80 from the strap 100. The buckle parts 142 and 144 can be repeatedly assembled, i.e. closed, and disassembled, i.e. opened, as described. Since the buckle 140 is a standard safety buckle, a standard auto-release buckle, further details of the buckle parts 142 and 144 will readily occur to the person having ordinary skill in the art.

In FIGS. 4 and 5, the strap 80 extends outward from the back support's 62 pocket 68 from side 66 to the buckle part 142. In FIGS. 8 and 9, the strap 80 threads through the tongue 145, over the connecting end 146 and doubles back over and is secured to the strap's 80 standing part by, such as by stitching, forming a closed loop 80B over the connecting end 146, securing the strap 80 to the buckle part 142.

The strap 100 is coupled between the buckle part 162 in FIGS. 1, 4 and 5 and the buckle part 144 in FIGS. 1, 3, 4, and 5. In FIGS. 8 and 9, the strap 90 threads through the eyelet 149 and doubles back over the eyelet 149 and over and is secured to the strap's 100 standing part, such as by stitching, forming a closed loop 100A over the buckle part 144, securing the strap 100 to the buckle part 144.

Figure 12:
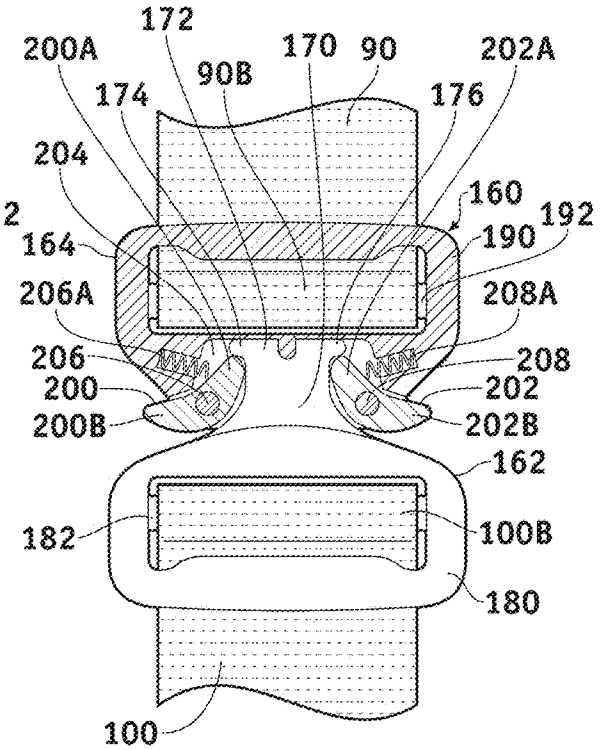
FIG. 12 is a view corresponding to FIG. 11, illustrating the two buckle parts as assembled or closed, closing the loop therebetween, one of the two buckle parts partially sectioned for illustrative purposes.
Figure 11:
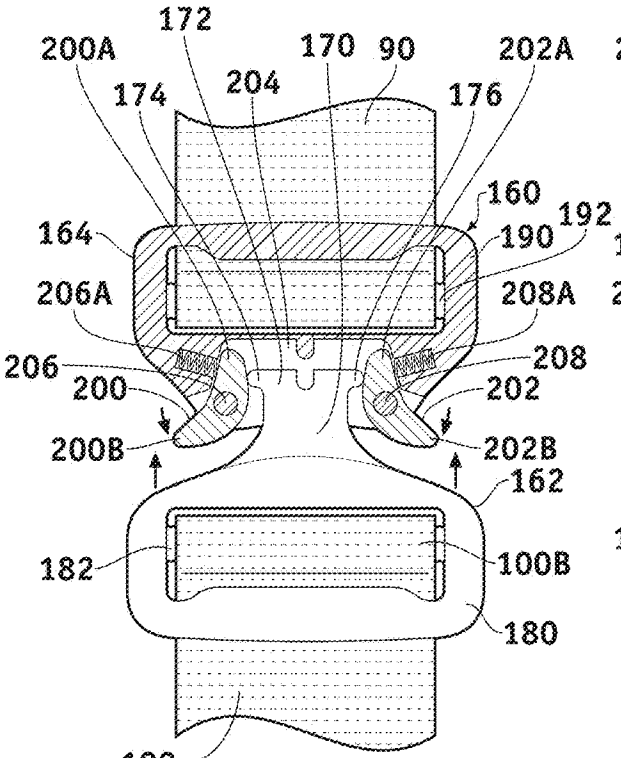
FIG. 11 is a view corresponding to FIG. 10, illustrating the two buckle parts as partially assembled, one of the two buckle parts partially sectioned for illustrative purposes.
Figure 10:
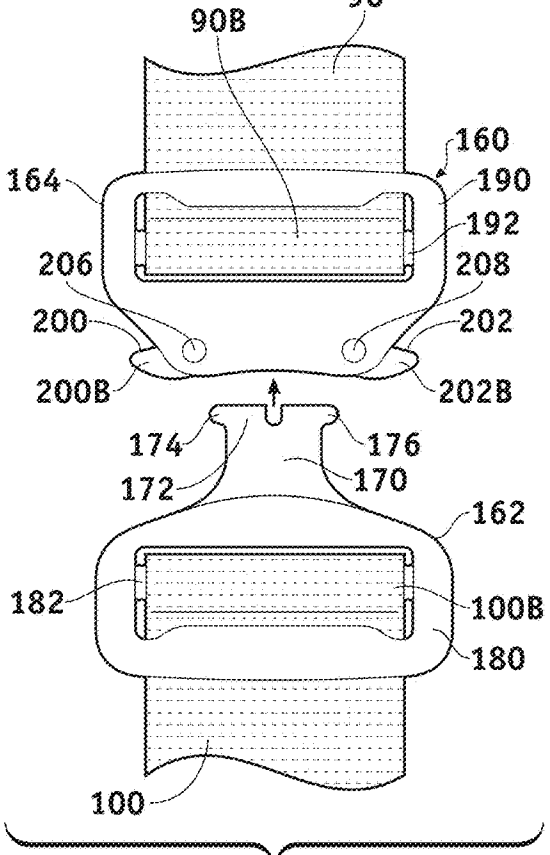
FIG. 10 is a fragmentary view of the training harness of FIGS. 4 and 5, illustrating two buckle parts of yet another one of the buckles as disassembled or opened, opening the loop therebetween.

In FIGS. 10, 11, and 12, the buckle 160 is a spring-loaded, dual latch-action, quick-release buckle, a stout, strong, rugged device of standard construction fashioned of metal, such as heavy-duty steel, zinc alloy, aluminum or other like or similar material or combination of materials. The buckle part 162 is a male buckle part. The buckle part 164 is a female buckle part. The buckle parts 162 and 164 are configured to be easily, quickly, and repeatedly assembled, i.e. closed, and disassembled, i.e. opened.

The buckle part 162 is a flat body or frame. It has a tongue 170 and an eyelet 180. The tongue 170 protrudes centrally from the eyelet 180, a ring or annular part of the buckle part 162, to a free end 172 configured with opposed abutments 174 and 176. The eyelet 180 is configured with a transversely extending bar 182. The bar 182 is a fixed bar or a displaceable clamping bar. The abutments 174 and 176 project outward laterally from either side of the tongue 170. The abutments 174 and 176 are identical mirror image counterparts. The strap 100 is coupled between the buckle part 162 in FIGS. 1, 4 and 5 and the buckle part 144 in FIGS. 1, 3, 4, and 5. In FIGS. 10, 11, and 12, the strap's 100 free end 102 extending to the buckle part 162 threads through the eyelet 180, around the bar 182, and doubles back over but is not secured to the strap's 100 standing part, forming an open loop 100B, securing the strap 100 to the buckle part 162. Guiding the strap 100 back and forth through the eyelet 180 over the bar 182 allows a user to adjust the strap's 100 length between the buckles 140 and 160, between the buckle's 140 buckle part 142 and the buckle's 160 buckle part 162. In FIGS. 4 and 5, a suitable coupling or band 186 holds the free end 102 and strap's 100 standing part together, preventing the free end 102 from flapping about.

In FIGS. 10, 11, and 12, the buckle part 164 is a flat body or frame. It has an eyelet 190 and an opposing central socket or receiver 204. The eyelet 190, a ring or annular part of the buckle part 164, is configured with a transversely extending bar 192. The bar 192 is a fixed bar or a displaceable clamping bar. Pivotally attached, spring-loaded latches 200 and 202 are on either side of a central socket or receiver 204. Pivot pins 206 and 208 pivotally connect the respective latches 200 and 202. The two latches 200 and 202 are identical mirror image counterparts. The latch 200 has an inner end 200A and an outer end 200B on either side of its pivot pin 206. The inner end 200A extends into the receiver 204. The outer end 200B extends outward from the receiver 204. The latch 202 has an inner end 202A and an outer end 202B on either side of its pivot pin 208. The inner end 202A extends into the receiver 204. The outer end 202B extends outward from the receiver 204. The receiver 204 is open to receive the buckle part's 162 tongue 170 and extends into the buckle part 164 toward the eyelet 180. The strap 90 is coupled between the buckle part 124 and the buckle part 164, in FIGS. 1, 4 and 5. In FIGS. 6 and 7, the strap 90 extending to the buckle part 124 threads through the eyelet 130 and doubles back over the eyelet 130 and over and is secured to the strap's 90 standing part, such as by stitching, forming a closed loop 90A, securing the strap 90 to the buckle part 124. The strap extending to the buckle part 164 threads through the eyelet 180, around the bar 192, and doubles back and is secured to the strap's 90 standing part, such as by stitching, forming a closed loop 90B, securing the strap 90 to the buckle part 164. Accordingly, the length of the strap 90 is fixed between the buckle parts 124 and 164.

The process of assembling the buckle parts 162 and 164 is quick, easy, and requires no specialized skill. The user connects the buckle part 162 to the buckle part 164 by hand, by holding one of the buckle's 160 buckle parts in one hand and the other one of the buckle's 160 buckle parts in her other hand. In FIG. 11, she initially inserts the tongue 170 free end 172 first into the to the receiver 204, engaging the abutments 174 and 176 against the inner ends 200A and 202A of the respective latches 200 and 202 now in their normal closed positions in FIG. 10 under the constant influence of their respective springs 206A and 206B, shown in FIGS. 11 and 12. As is known in the art, the springs 206A and 208A enclosed in the buckle part 164 constantly act directly against the outer ends 200A and 202A of the respective latches 200 and 202, constantly urging the latches 200 and 202 into their normal closed positions. She drives the free 172 into the receiver 204, urging the abutments 174 and 176 against the respective inner ends 200A and 202A with a force sufficient to overwhelm their respective springs 206A and 206B, pivoting the latches 200 and 202 out of their normal closed positions in FIG. 10 to their open positions in FIG. 11. She continues applying the specified force. This allows the abutments 174 and 176 to slide over and beyond the inner ends 200A and 202A of the now open latches 200 and 202 and into the receiver 204 to its installed position inserted in the receiver 204 in FIG. 12. Now free from the abutments 174 and 176, the latches 200 and 202 automatically pivot forcibly under the influence of their respective springs 206A and 206B out of their open positions in FIG. 11 to their normal closed positions in FIG. 12, interference positions of the inner ends 200A and 202A relative to the respective abutments 174 and 176 of the now-installed tongue 170, preventing withdrawal of the tongue 170 from the receiver 204, securing the buckle part 162 to the buckle part 164 in FIG. 12, securing the strap 90 to the strap 100. The assembled buckle 160 is sleek and flat.

In an alternate embodiment, the user connects the buckle part 162 to the buckle part 164 by actuating the buckle part 164 by hand, by pressing downward by hand against the outer ends 200B and 202B of the respective latches 200 and 202 with force sufficient to overwhelm their respective springs 206A and 206B, pivoting the latches 200 and 202 out of their normal closed positions to their open positions. Holding the latches 202 and 202 in their open positions, she inserts the tongue 170 free end 172 first into the receiver 204 without interference from the inner ends 200A and 202A of the now open latches 200 and 202 to the tongue's 170 installed position. She releases the latches 200 and 202 by releasing the force applied to their outer ends 200B and 202B, allowing the latches 200 and 202 to automatically pivot forcibly under the influence of their respective springs 206A and 208A out of their open positions to their normal closed positions, interference positions of the inner ends 200A and 202A relative to the respective abutments 174 and 176 in FIG. 12, preventing withdrawal of the tongue 170 from the receiver 204, securing the buckle part 162 to the buckle part 164 in FIG. 12, securing the strap 90 to the strap 100.

The user quickly and easily separates the buckle parts 162 and 164 by actuating the buckle part 164, by pressing downward by hand against the outer ends 200B and 202B of the respective latches 200 and 202 with force sufficient to overwhelm their respective springs 206A and 206B, pivoting the latches 200 and 202 out of their normal closed positions to their open positions, withdrawing their interference of the inner ends 200A and 202A from the respective abutments 174 and 176, releasing the latches 200 and 202 from the tongue 170. She withdraws the tongue 170 from the receiver 204 in FIG. 10 by pulling them apart, separating the buckle parts 162 and 164, separating the strap 90 from the strap 100. She releases the latches 200 and 202, allowing them to pivot forcibly under the influence of their respective springs 206A and 208B out of their open positions in FIG. 11 to their normal closed positions in FIG. 12. The user can repeatedly assemble, i.e. close, and disassemble, i.e. open, the buckle parts 162 and 164, as described. Since the buckle 160 is a standard quick-release buckle, further details of the buckle parts 162 and 164 will readily occur to the person having ordinary skill in the art.

When the buckle parts 122 and 124 of the buckle 120 are secured in FIGS. 4, 5, and 6, they secure the strap 80 to the strap 90. When the buckle parts 122 and 124 of the buckle 120 are released in FIG. 7, they release the strap 80 from the strap 90. When the buckle parts 142 and 144 of the buckle 140 are secured in FIGS. 4, 5, and 8, they secure the strap 80 to the strap 100. When the buckle parts 124 and 144 of the buckle 140 are released in FIG. 8, they release the strap 80 from the strap 100. When the buckle parts 162 and 164 of the buckle 160 are secured in FIGS. 4, 5, and 12, they secure the strap 80 to the strap 100. When the buckle parts 162 and 164 of the buckle 160 are released in FIG. 10, they release the strap 80 from the strap 100. When the buckle parts 122 and 124 of the buckle 120 are secured in FIGS. 4, 5, and 6, securing the strap 80 to the strap 90, the buckle parts 142 and 144 of the buckle 140 are secured in FIGS. 4, 5, and 8, securing the strap 80 to the strap 100, and the buckle parts 162 and 164 of the buckle 160 are secured in FIGS. 4, 5, and 12, securing the strap 80 to the strap 100, the straps 80, 90, and 100 and the secured buckles 120, 140, and 160 close the harness 62 to form the loop 70 of the straps 80, 90, and 100, and the assembled buckles 120, 140, and 160, extending outward from the respective sides 64 and 66 of the back support 62, in FIGS. 4 and 5. The harness's 62 loop 70 can be opened by releasing the buckle parts 122 and 124 of the buckle 120, releasing the buckle parts 142 and 144 of the buckle 140, or releasing the buckle parts 162 and 164 of the buckle 160.

The harness 60 is configured be wrapped under tension around the horse 20 and its rider 30 for promoting, encouraging, or otherwise reinforcing recommended saddle-sitting techniques by the rider 30. Referring to FIGS. 1-3, relevantly, a user installs the harness 60 with the rider 30 sitting astride on the saddle 40 described above. She places the strap 80 around the rider's 30 lower back, situating the back support 62 against the rider's 30 lower back proximate to and over the back of the saddle 40 so the back support 62 extends from side 64 toward the left side of the rider's 30 lower back to side 66 toward the right side of the rider's 30 lower back. She extends the strap 80 outward from side 64 of the back support 62 and downwardly and forwardly across the rider's 40 left side, across the rider's 30 left hip to the buckle part 122 of the assembled buckle 120 over the rider's 30 left thigh of the left leg 32. She extends the strap 90 downward from the buckle part 124 of the assembled buckle 120 over the rider's 30 left thigh and downward over the side 42 of the saddle 40 over the horse's 20 left side to the buckle part 164 just below the saddle 40 and the pad 56 just ahead of the rider's 30 left lower leg between her left knee and her left foot 36, in this example shown situated in the saddle's 40 left stirrup 54.

She extends the opposing side of the strap 80 outward from side 66 of the back support 62 downwardly and forwardly across the rider's 30 right side, across the rider's 30 right hip to the buckle part 142 above the buckle part 144 of the assembled buckle 140 over the rider's 30 right thigh of the right leg 34. The tongue 151 faces outwardly and extends downward from its inner end 152 secured to the buckle part 142 to its outer end 153. She extends the strap 100 downward from the buckle part 144 of the assembled buckle 140 over the rider's 30 right thigh, downward over the side 44 of the saddle 40 over the horse's 20 right side, across and over the saddle's 40 girth strap 46 extending over the underside of the horse's 20 barrel 54 underside just behind the horse's front legs 26 from the right side of the horse 20 to the left side of the horse 20, and upwardly along the horse's 20 left side to the buckle's 160 buckle part 162, which she secures by hand to the buckle's 160 buckle part 164 as described above. This forms the loop 70 between the rider 30 and her horse 20, the loop 70 being wrapped around the horse 20 and its rider 30. She tensions the loop 70 between the rider 30 and her horse 20 by tightening the loop 70, such as by pulling the strap's 80 free end 82 now extending rearward from the rider's 30 left hip through the buckle part's 122 eyelet 128, tightening the loop 70 over the saddle's 40 girth strap 46 and the rider's 30 left and right sides, over the left and right sides of her hip and the thighs of her left and right legs 32 and 34, and the back support 62 over and across the rider's lower back. If desired, she can also pull the strap's 100 free end 102 through the eyelet 180 over the bar 182 to tighten and thereby tension the loop 70. Importantly, the buckle 160 lays flat along the horse's 20 left side near and just in front of the rider's left leg just below the saddle 40 and blanket 56 and above the saddle's 40 left stirrup 54 with the buckle part 164 above the buckle part 162. This allows the rider 30 to comfortably bend forward on the saddle 51 and easily and efficiently reach the buckle 160 with her left hand without having to exit the saddle 40, for actuating the buckle part 164 with just her left hand to release it from the underlying buckle part 162.

In the now-installed harness 60 wrapped under tension around the horse 20 and its rider 30, the harness 60 tensioned or otherwise tightened between the horse 20 and its rider 30, the back support 62 is tensioned forwardly against the rider's 30 lower back proximate to and over the saddle 40. The loop's 70 sections 72 and 74 are on either side of the horse 20. The loop's 70 section 72 extends outward, downwardly, and forwardly from the pocket 68 from the side 64 of the back support 62 across the side of the rider's 30 left hip to the buckle part 122 of the assembled buckle 120 over the rider's 30 left thigh and downward from the buckle part 124 of the assembled buckle 120 over the rider's 30 left thigh and downward over the side 42 of the saddle 40 and the horse's 20 left side to the buckle part 164 above the buckle 162 of the assembled buckle 160 just below the saddle 40 and the pad 56 ahead of the rider's 30 lower left leg 32 between her left knee and her left foot 36 in the saddle's 40 left stirrup 54. The loop's 70 section 74 opposite to the loop's 70 section 72 extends outward, downwardly, and forwardly from side 66 of the back support 62 across the side of the rider's 30 right hip to the buckle part 142 above the buckle part 144 of the assembled buckle 140 over the rider's 30 right thigh. The loop's 70 section 76 between the buckle parts 144 and 162 extends downward from the buckle part 144 of the assembled buckle 140 over the rider's 30 right thigh, downward over the side 44 of the saddle 40 and the horse's 20 right side, over the saddle's 40 girth strap 46 extending over the underside of the horse's 20 barrel 24 just behind the horse's 20 front legs 26 from the horse's 20 right side to its left side, and upwardly along the horse's 20 left side to the buckle's 160 buckle part 162 secured to the buckle's 160 buckle part 164.

In FIG. 3, she loops the strap's 154 loop 155 over the rider's 30 right wrist of her right arm 39A. The tongue 151 in its closed position secures buckle part 142 to buckle part 144, securing strap 80 to strap 100. Pulling the strap 120 upwardly against the latch's 151 outer end 153 pivots the tongue 151 out of its closed position to its open position, releasing the buckle part 142 from the buckle part 144, allowing them to be separated in FIG. 9 and the buckle part 144 under the buckle part 142 to automatically fall downwardly from the overlying buckle part 142 under the influence of gravity, separating the strap 80 from the strap 100, opening the loop 70. This frees the rider 30 and her horse 20 from the influence of the harness 60. The rider 30 can pull upwardly on the strap 120 deliberately when she wishes to immediately release herself and her horse 20 from the influence of the harness 60 or inadvertently, such as by losing her balance.

If desired, the harness 60 can have attached auxiliary the straps configured to clip onto and secure the saddle's 40 rigging on either side of the saddle's 40 pommel, such as auxiliary the strap 210 extending outwardly to a standard clip 212 from the strap 90 proximate to the buckle part 162 and auxiliary the strap 214 extending outwardly to a standard clip 216 from the strap 100 proximate to the buckle part 144, shown in FIGS. 4 and 5. Securing the clips 216 to the saddle's 40 rigging retains the harness 60 to the saddle 40 when the loop 70 is opened. When the loop 70 is opened by opening any one of the buckles 120, 140, and 160, releasing the rider 30 and her horse 20 from the influence of the harness 60, she may detach the harness 60 from the saddle 40 by releasing the clips 212 and 216 from the saddle's 40 rigging. The harness 60 may be repeatedly installed and removed as described.

The now-installed harness 60 tightened to be tensioned between the horse 20 and its rider 30 physically promotes, encourages, or otherwise reinforces the rider to sit on the saddle 40 according to the recommended saddle-sitting techniques by a forward tension exerted by the back support 62 directly against the rider's 30 lower back, urging the rider 30 to sit upright, and a downward tension exerted by harness's 62 sections 72 and 74 directly against either side of the rider 30, section 72 against the side of the rider's 30 left hip and against her left thigh of her left leg 32 and section 74 against the side of the rider's 30 right hip and against her right thigh of her right leg 34, urging the rider 30 downward into the saddle 40. The described influence exerted against the rider 30 by the harness 60 coupled between her and her horse 20 physically promotes, encourages, or otherwise reinforces the rider 30 to sit on the saddle 40 according to the recommended saddle-sitting techniques, namely, upright, with open hips, steady legs under the body, a relaxed and supple back, an open upper body, and shoulders, back, elbows, hands, and head in their correct and relaxed positions.

Figure 14:
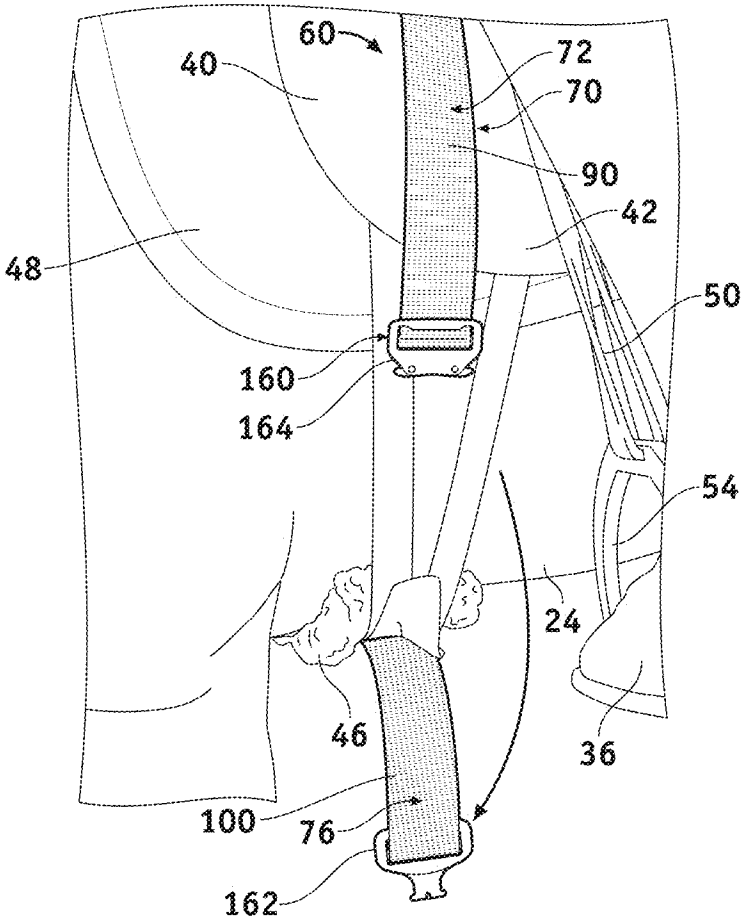
FIGS. 13 and 14 are enlarged fragmentary view corresponding to FIG. 11, illustrating a sequence of disassembling of the two buckle parts, opening the loop therebetween for releasing training harness from the horse and its rider.
Figure 13:
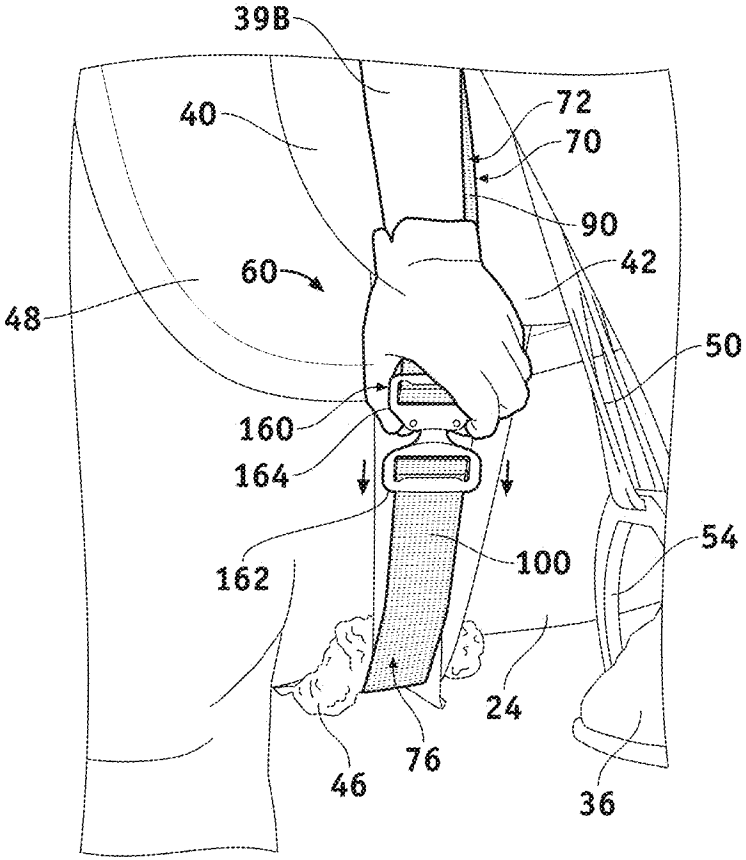

According to the invention, the expedient of the buckle 160, an exemplary quick-release buckle, enables the user to install the harness 60 over the horse 20 and its rider 30 quickly and efficiently. According to the invention, the expedient of the buckle's 160 position on the harness 60 when coupled between the rider 30 and her horse 20 as described allows the rider 30 to reach down with her left hand of her left arm 39B in FIGS. 13 and 14 and easily, efficient, and without interference or restriction quickly disassemble the buckle 160 by actuating the buckle part 164 with just her left hand, by pressing downward against the outer ends 200B and 202B of the respective latches 200 and 202 of the buckle part 164 with the fingers of her left hand with a force sufficient to overwhelm their respective springs 206A and 206B, pivoting the latches 200 and 202 out of their normal closed positions to their open positions, withdrawing their interference of the inner ends 200A and 202A with the respective abutments 174 and 176, releasing the latches 200 and 202 from the tongue 170. This allows the buckle part 162 under the buckle part 164 and not taken up by the rider's 30 left hand to automatically withdraw and fall downwardly from the buckle part 164 under the influence of gravity, efficiently separating the buckle parts 162 and 164, releasing the strap 80 from the strap 100, opening the loop 70. This frees the rider 30 and her horse 20 from the influence of the harness 60. Upon opening the latches 200 and 202, releasing the buckle part 162 from the buckle part 164, the inherent tension across the harness 62 causes the buckle parts 162 and 164 to automatically separate and the buckle part 162 to automatically fall downward under the influence of gravity without further assistance from the rider 30 in FIG. 13 according to the invention.

Since the loop 155 of the strap 154 is over the rider's 30 right wrist and the rider's left arm 39B is not in any way harnessed to or encumbered by the harness 60, the rider 30 can reach down with her left hand without interference or restriction to quickly and independently disassemble the buckle 160 on the left side of the horse 20. This is why the buckle 160 is on the rider's 30 left side and the horse's 20 left side and not on the rider's 30 right side and the horse's 20 right side where the buckle 140 is located. Locating the buckle 160 on the horse's 20 right side with the strap 154 coupled between the buckle 140 and the rider's 30 right wrist would inherently restrain the rider 30 from accessing the buckle 160 with her right hand. It could also cause her to inadvertently pull the strap 154, disassembling the buckle parts 142 and 144 thereby releasing the strap 80 from the strap 100 unintentionally, opening the loop 70, if she attempted to reach toward the buckle 160 to activate it with her right hand.

The installation of the harness 60 between the rider 30 and her horse 20 can be flipped or otherwise reversed. In such an installation, the back support 62 is tensioned forwardly against the rider's 30 lower back proximate to and over the saddle 40. The loop's 70 sections 72 and 74 are on either side of the horse 20. The loop's 70 section 72 extends outward, downwardly, and forwardly from the pocket 68 from side 64 of the back support 62 across the side of the rider's 30 right hip to the buckle part 122 of the assembled buckle 120 over the rider's 30 right thigh and downward from the buckle part 124 of the assembled buckle 120 over the rider's 30 right thigh and downward over the side 44 of the saddle 40 and the horse's 20 right side to the buckle part 164 above the buckle 162 of the assembled buckle 160 just below the saddle 40 and the pad 56 ahead of the rider's 30 lower right leg 34 between her right knee and her right foot 38 in the saddle's 40 right stirrup 56. The loop's 70 section 74 opposite to the loop's 70 section 72 extends outward, downwardly, and forwardly from side 66 of the back support 62 across the side of the rider's 30 left hip to the buckle part 142 above the buckle part 144 of the assembled buckle 140 over the rider's 30 left thigh. The loop's 70 section 76 between the buckle parts 144 and 162 extends downward from the buckle part 144 of the assembled buckle 140 over the rider's 30 left thigh, downward over the side 42 of the saddle 40 and the horse's 20 left side, over the saddle's 40 girth strap 46 extending over the underside of the horse's 20 barrel 24 just behind the horse's 20 front legs 26 from the horse's 20 left side to its right side, and upwardly along the horse's 20 right side to the buckle's 160 buckle part 162 secured to the buckle's 160 buckle part 164. The strap's 154 loop 155 would be looped over the rider's 30 left wrist. The operation of the harness 60 in this flipped installation is the same as before.

Figure 15:
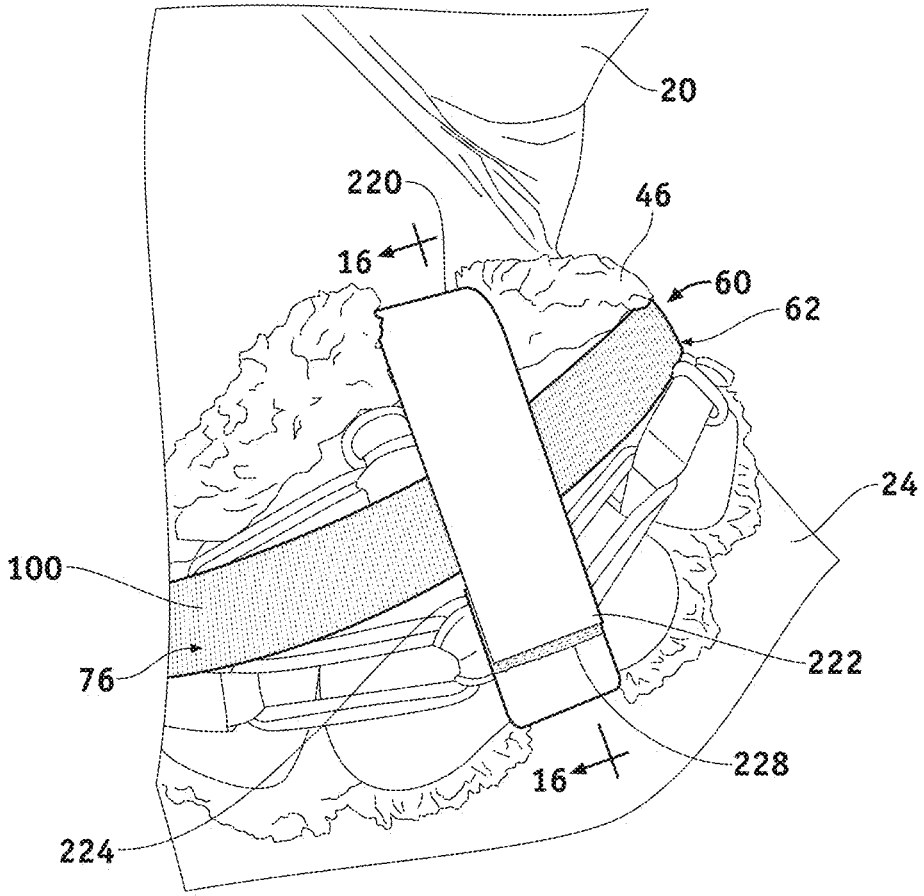
FIG. 15 is a perspective view corresponding to FIG. 1, illustrating a retention band girdling the saddle's girth strap cinch and the training harness applied thereover.
Figure 16:
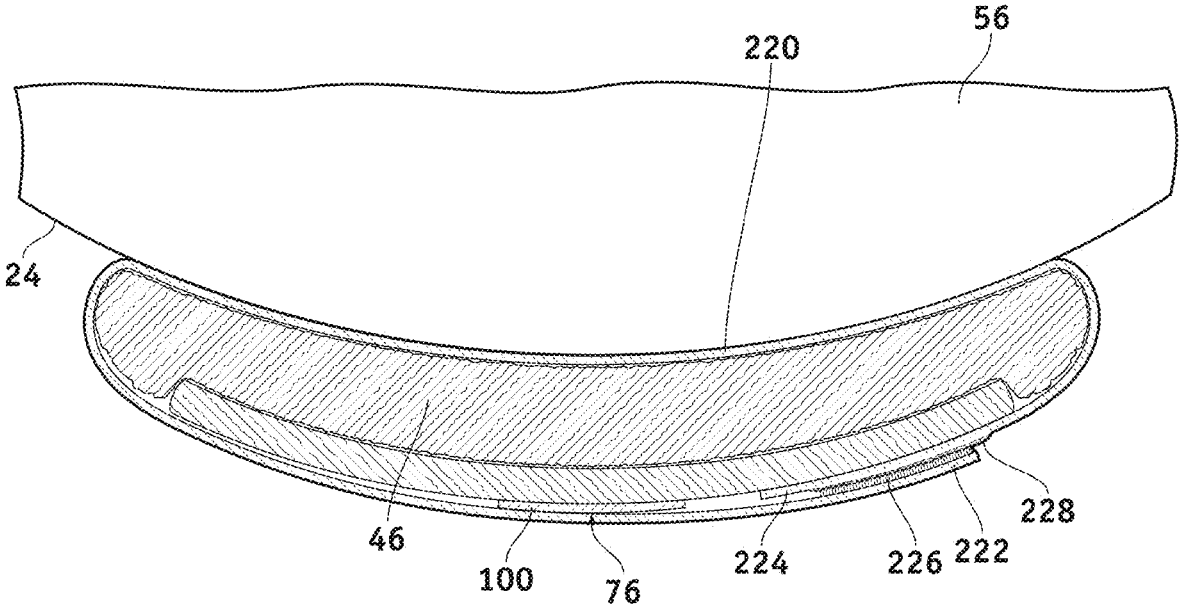
FIG. 16 is a generalized section view take along line 16-16 of FIG. 15.

In FIGS. 15 and 16, the installation of the harness 60 additionally includes the provision of a retention band 220. The retention band 220, a fabric strip of fleece or other material or combination of materials having inherently soft, flexible, and resilient material characteristics, has opposed extremities or ends 222 and 224. The retention band 220 extends longitudinally across the underside of the horse's 20 barrel 24 between the underside of the horse's 20 barrel 24 and transversely across the horse-engaging side of the saddle's 40 girth strap 46. The strap's 220 ends 222 and 224 extend outward from either side of the girth strap 46. They are pulled outwardly over the girth strap's 46 outer side and across the strap 100. The ends 222 and 224 are overlapped, pulled tight, and secured to one another. So installed, the retention band 220 girdles the saddle's 40 girth strap 46 and the training harness's 60 the strap 100 extending over it. The retention band 220 holds the strap 100 to the girth strap 46, stopping it from sliding fore or aft off the saddle's 46 girth strap directly against the horse's 20 underside, loosening the harness 62, causing the horse 20 to experience discomfort, and disrupting the proper installation of the harness 60, and falling away from the girth strap 46 when the loop 70 is opened. The retention band 220 holds section 76 to the girth strap 46 when the buckle parts 162 and 164 are separated, preventing the section 76 from falling away from the girth strap 46 and becoming entangled in the horse's 20 legs or startling the horse 20. The overlapping ends 222 and 224 are preferably secured to one another by a hook and loop fastener. One element 226 of the hook and loop fastener is attached, such as by stitching, to the retention band's 220 free end 222. The other element 228 of the hook and loop fastener is attached, such as by stitching, to retention band's 220 free end 224. In this example, the element 226 is a hook element and the element 228 is loop element, and this can be reversed. The loop element can, if desired, be the inherent material characteristic of the retention band 220 or a loop medium affixed to the free end 224. Other fastener formats can be used to secure the ends 222 and 224, such as a suitable buckle, snaps, etc. The user may install the retention band 220 between the girth strap 46 and the horse 20 when she saddles the horse 20 and then close it around the girth strap 46 and the strap 100 after installing the harness 60.

In an alternate embodiment, the retention band can be continuous and without free ends, girdling the saddle's 40 girth strap 46 and the training harness's 60 the strap 100 when the harness 60 is installed. If desired, the saddle's 40 girth strap 46 can be configured with its own attached loop, like a belt loop, to serve as the retention band. In each of these configurations, the user would simply thread the strap's 100 through the loop. The user may provide the retention band in any desired width or configuration. Although the installation of the harness 60 has one retention band, it may employ two or more of them as desired.

The present invention is described above with reference to illustrative embodiments. Those skilled in the art will recognize that changes and modifications may be made in the described embodiments without departing from the nature and scope of the present invention. Various changes and modifications to the embodiments herein chosen for purposes of illustration will readily occur to those skilled in the art. To the extent that such modifications and variations do not depart from the invention, they are intended to be included within the scope thereof.

Having fully described the invention in such clear and concise terms as to enable those skilled in the art to understand and practice the same, the invention claimed is:

1. A harness for use with a rider seated astride on a saddle secured atop a back of horse by a girth strap extending around a barrel of the horse from either side of the saddle, the harness for reinforcing recommended saddle-sitting techniques and comprising:

a loop comprising an assembly of interconnected straps and buckles, the straps including a first strap, a second strap, and a third strap, and the buckles comprising a first buckle, a second buckle, and a third buckle each openable for opening the loop;

the first strap extending between the first buckle and the second buckle, the second strap extending between the first buckle and the third buckle, and the third strap extending between the second buckle and the third buckle;

the first strap including a back support between the first buckle and the second buckle;

the first buckle, the third buckle, the first strap extending from the back support to the first buckle, and the second strap extending from the first buckle to the third buckle comprising a first section of the loop;

the second buckle and the first strap extending from the back support to the second buckle comprising a second section of the loop opposing the first section of the loop; and the third strap extending between the second buckle and the third buckle comprising a third section of the loop;

the loop configured be wrapped under tension around the horse from the back support applied against the rider's lower back so the first section and the second section extend outward, downwardly, and forwardly from the back support over either side of the rider and downward along either side of the horse, the third section extends over the girth from the second buckle to the third buckle below the first buckle, forward tension exerted by the back support against the rider's lower back urges the rider to sit upright, and downward tension exerted by the first section and second section against either side of the rider urges the rider downward into the saddle.

2. The harness according to claim 1, the second buckle comprising:

a first buckle part;

a second a buckle part, the second buckle part including a latch and a wrist strap extending from the latch;

the first buckle part received by the second buckle;

the latch in a closed position, securing the first buckle part to the second buckle part; and the latch movable out of the closed position to an open position, releasing the second buckle part from the first buckle part in response to pulling against the outer end by the wrist strap, opening the loop.

3. The harness according to claim 1, further comprising a retention band encircling the girth and the third section of the loop under the barrel of the horse.

* * * * *